United States Patent [19]

Farmer

[11] 4,088,324

[45] May 9, 1978

[54] ATHLETIC IMPLEMENT WITH VISUAL RANGE DISPLAY

[76] Inventor: Everett Walter Farmer, 3 Eastbrook Dr., Nashua, N.H. 03060

[21] Appl. No.: 747,413

[22] Filed: Dec. 6, 1976

[51] Int. Cl.[2] ..... A63B 69/36

[52] U.S. Cl. ..... 273/186 A; 273/DIG. 26

[58] Field of Search ..... 273/186 A, 183 D, 184 R, 273/185 R, DIG. 26, DIG. 28; 35/29 A

[56] References Cited

U.S. PATENT DOCUMENTS

| | | | |
|---|---|---|---|
| 3,270,564 | 9/1966 | Evans | 273/186 A X |
| 3,323,367 | 6/1967 | Searle | 273/183 D |
| 3,380,305 | 4/1968 | Charell | 273/186 A X |
| 3,762,720 | 10/1973 | Jett | 273/183 D |

*Primary Examiner*—George J. Marlo
*Attorney, Agent, or Firm*—Wigman & Cohen

[57] ABSTRACT

An athletic implement, having a self-contained, built-in system for measuring impact between the implement and a struck object and for displaying the distance traveled by the struck object is disclosed. In the disclosed preferred embodiment, the athletic implement comprises a golf club having an acceleration sensor mounted in the club head for detecting the deceleration shock pulse generated upon striking a golf ball with the club head. The sensor transmits an analog electrical signal proportional to the peak amplitude of the shock pulse to battery-powered electronic circuits mounted in the club handle. The electronic circuits convert the analog signal to digital signals proportional to range or distance traveled by the ball and transmits the same to a decoder/driver which drives a digital display such as a LCD or LED display mounted in the end of the club handle. After the ball is struck with the club, a display "on" switch is activated by pressure applied to a predetermined location on the handle to display range numerically in yards on the digital display.

9 Claims, 6 Drawing Figures

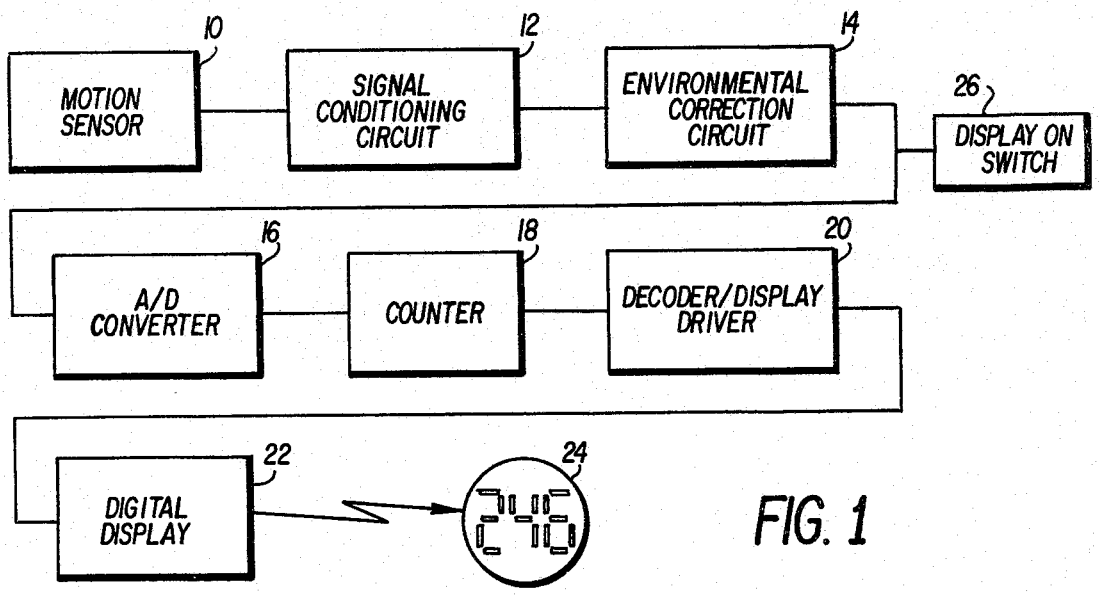
FIG. 1
FIG. 2
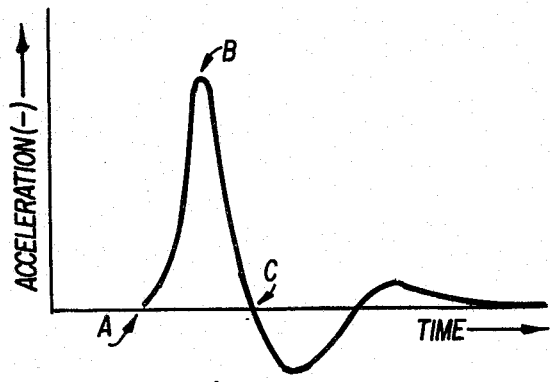
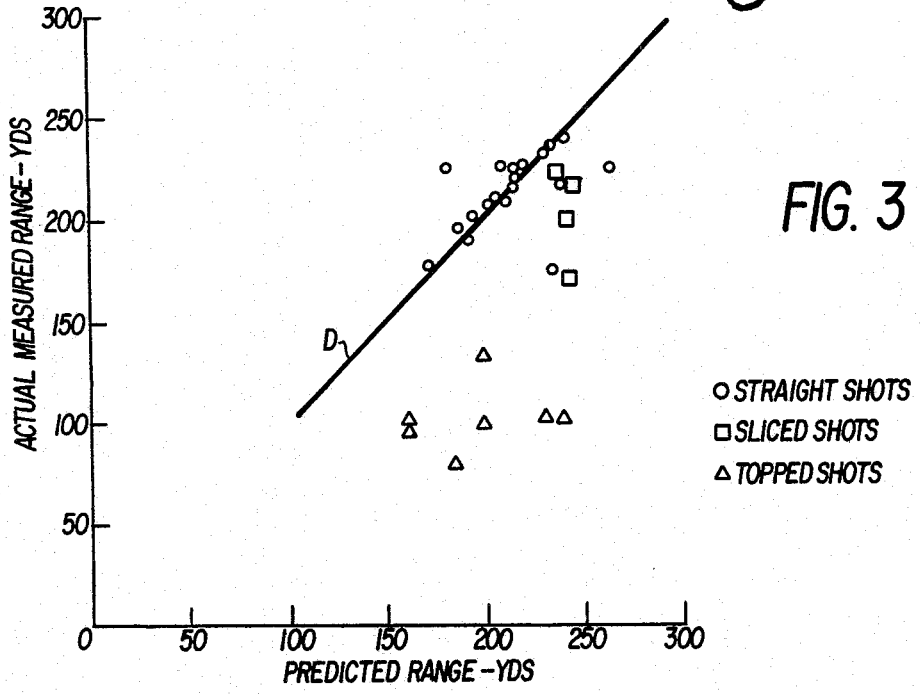
FIG. 3

ATHLETIC IMPLEMENT WITH VISUAL RANGE DISPLAY

BACKGROUND OF THE INVENTION

The present invention relates generally to athletic implements and more particularly to athletic implements, such as a golf club, which include means for measuring and displaying the distance traveled by a ball or the like struck by the athletic implement.

A search of the prior art failed to uncover any patents which disclose the apparatus of the present invention. A number of patents were uncovered which disclose various systems used to measure the characteristics of the swing of an athletic implement, club velocity and the like.

While the aforementioned systems and devices are capable of supplying useful information of selected dynamic characteristics of a golf stroke for the purpose of analyzing the accuracy, form, effectiveness, velocity and the like of the stroke, they do not provide the golfer with a quick and reliable system for measurement and numeric visual display of the distance of his drive which can be utilized during actual participation in the game. Not only do most of these systems fail to provide numerical range information, many are too unwieldy to conveniently transport about a golf course during actual play and are, therefore, limited primarily for use as teaching and/or practice aids. Thus, the prior art devices do not disclose an athletic implement having a self-contained system for measuring impact between the implement and a struck object and for numerically displaying range or distance traveled by the struck object.

SUMMARY AND OBJECTS OF THE INVENTION

In view of the foregoing limitations and shortcomings of the prior art devices, it is a primary object of this invention to provide an athletic implement having a self-contained system for measuring a shock pulse produced by the impact between the implement and a struck object and for visually displaying range or distance traveled by the struck object to the user.

It is another object of this invention to provide a golf club having a built-in range measuring and display system and which can be utilized for practice purposes as well as for actual play of the game of golf.

Another object of this invention is to provide an economical range measuring golf club which measures and numerically displays the distance of a golf drive based on the characteristics of the impact between the club head and a golf ball.

Still another object of this invention is to provide an improved, economically constructed, lightweight and compact range measuring system for a golf club which can be readily incorporated in the club itself.

It is known that the distance traveled by a struck object, such as a golf ball, is a function of the initial velocity imparted to the object. It can be readily shown by mathematical analysis of the impact phase of the swing of a golf club, that the distance traveled by a struck ball is a function of the deceleration of the club head which may be in excess of 25,000 G's. Parameters which affect the relationship between club head deceleration and distance traveled are the club head weight and the coefficient of restitution and durometer of the ball. The weight of the golf club head is readily determined and accurately controlled by manufacturers as is the coefficient of restitution of the golf ball. The durometer of the ball affects the time duration and amplitude of the deceleration shock pulse and is likewise controlled by individual manufacturer's quality control standards. Thus, the variability of these parameters can be readily taken into account and will not appreciably affect the results achieved.

Briefly described, the aforementioned objects of the present invention are accomplished by providing an athletic implement, e.g., a golf club, having a motion sensing transducer mounted in the head thereof for producing an analog output voltage signal proportional to the magnitude of the deceleration shock pulse generated upon impact of the club head with a ball. The transducer output is electrically connected to battery-powered integrated circuits mounted in the club handle and which include a signal conditioning circuit for storing the transducer output voltage, an A/D converter where the analog voltage output of the transducer is received from the signal conditioning circuit, converted into digital signals and supplied to a counter. The output of the counter is fed, in turn, to a display driver which drives a visual display, such as a LED or LCD-type digital display. The LED/LCD display is mounted in a recess provided at the end of the club handle and is protected by a transparent window through which the display is viewed. A pressure-activated switch is arranged in the handle for energizing the display circuits to display the digital signals in the form of a numerical distance read-out in yards. The electronic circuits and digital display means are advantageously located adjacent the end of the club handle to minimize the shock forces which these components must withstand.

While the embodiments of the present invention are disclosed in relation of a golf club of the so-called "wood" type, it will be appreciated by those skilled in the art to which the invention pertains that the range measurement and display system disclosed herein may be utilized in connection with other athletic implements, such as tennis racquets, hockey sticks, baseball bats and the like. Moreover, the invention may also be utilized in connection with other, not specifically mentioned impact-type implements wherein it is desired to determine the distance traveled by a struck object as a function of the impact shock pulse.

With these and other objects, advantages and features of the invention that may become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 1 diagramatically illustrates a distance measuring system for an athletic implement according to the present invention;

FIG. 2 illustrates a graphic plot of a typical deceleration shock pulse of a golf club head as a function of time for a typical golf stroke;

FIG. 3 is a graphic plot showing typical accuracy of the range measuring system of the present invention as determined in actual testing;

DETAILED DESCRIPTION OF A PREFERRED EMBODIMENT

Figure 4:
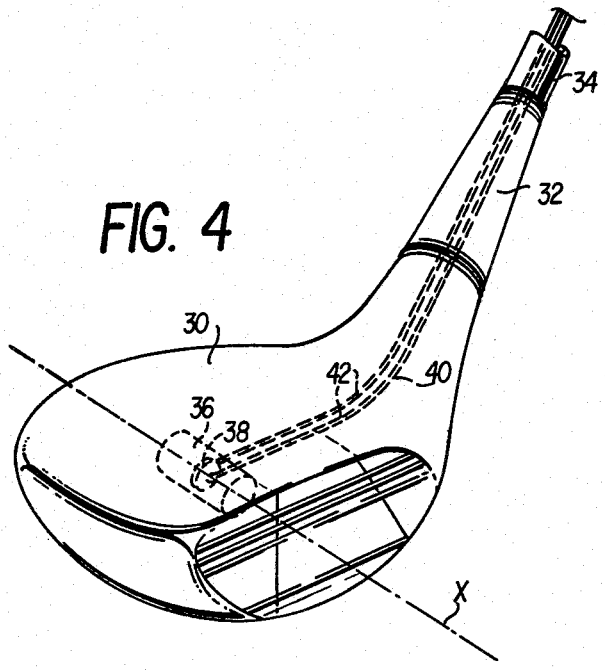
FIG. 4 is a perspective view showing a preferred embodiment of the arrangement of the motion sensor in a golf club head.
Figure 5:
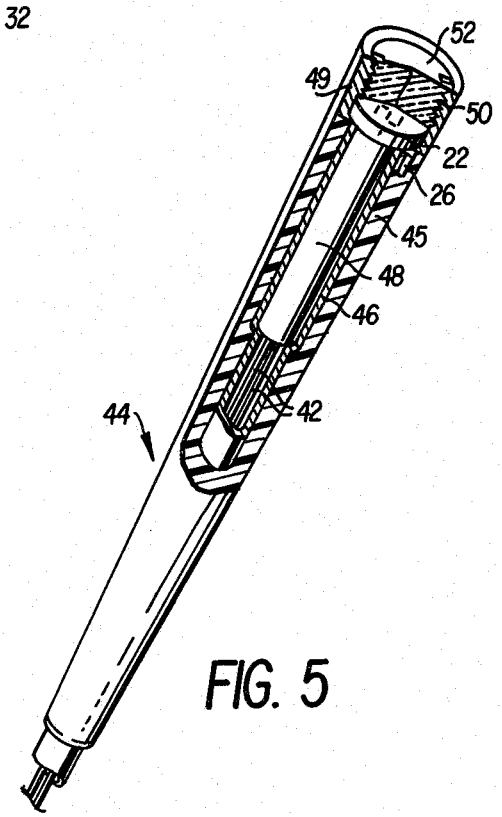
FIG. 5 is a perspective view, partly broken, showing a preferred embodiment of the arrangement of the electronic circuits and digital display in a golf club handle.
Figure 6:
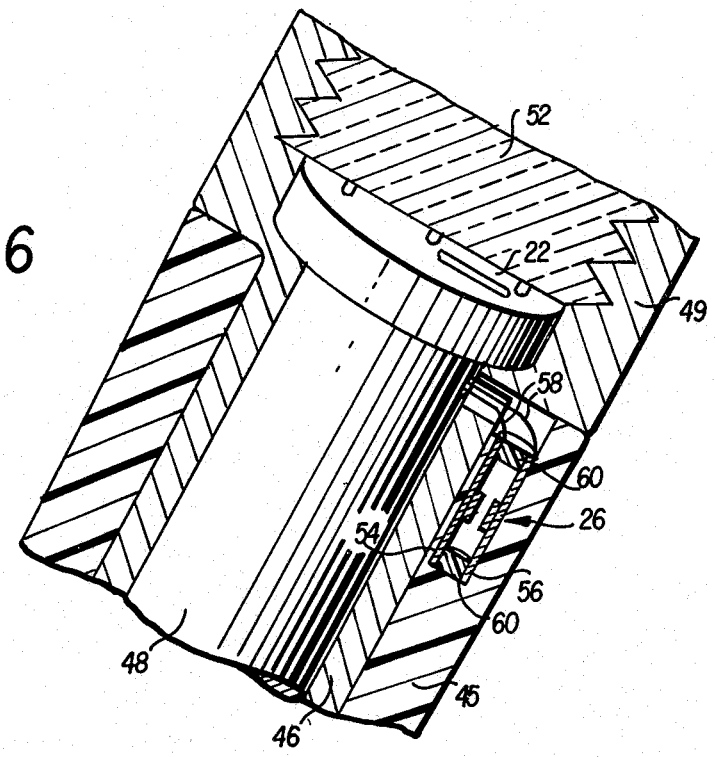
FIG. 6 is an enlarged broken view in perspective showing the switching arrangement for energizing the range display according to the invention.

Referring now in detail to the drawings, FIG. 1 schematically illustrates a preferred range measuring and display system for use in an athletic implement made in accordance with the present invention. For a better understanding of the present invention and, in particular, a preferred embodiment, e.g., a golf club, as shown in FIGS. 4–6 herein, reference is now made to the circuitry shown in FIG. 1. A motion sensor 10 senses the deceleration shock pulse of a golf club head upon impact with a golf ball and produces an analog voltage output signal which is approximately proportional to distance traveled by the struck ball. The output of sensor 10 is connected to a signal processing circuit which includes a signal conditioning circuit 12 for receiving and storing the output voltage signal produced by sensor 10. Preferably, signal conditioning circuit 12 includes a capacitive storage device and a circuit for calibrating the system. The output of the signal conditioning circuit 12 is fed to an optionally provided environmental correction circuit 14 which may comprise a variable resistor to correct for environmental effects, such as wind speed and direction, terrain geometry, turf conditions, ambient temperature, etc. The output of environmental correction circuit 14 is fed to an analog-to-digital converter 16 where the analog output of the sensor 10 is converted into digital signals and applied to a counter 18. The A/D converter and counter preferably comprise an integrated circuit of conventional construction. The digital output of counter 18 is supplied to a display decoder/driver 20 which drives a digital display 22, such as a LED or LCD display, a typical display in yards being shown in FIG. 1 and designated by reference numeral 24.

A display "on" switch 26 is connected to the input of A/D converter 16 and is operated by the user to apply the analog output voltage stored in circuit 12 to the analog-to-digital and range display circuits of the system after a golf ball has been struck. The details and operation of switch 26 are more fully described hereinafter in connection with FIG. 6.

One integrated circuit which has been found suitable for use for the A/D converter 16 and counter 18 of the present invention is manufactured by Siliconix, Inc. of Santa Clara, California under the designation LD130 ± 3 Digit A/D Converter. Siliconix, Inc. Application Note AN 76—5 of July 1976, the disclosure of which is incorporated herein by reference, describes the operation of the LD130 A/D converter and the manner in which it may be interfaced with conventional LED/LCD digital displays. A standard decoder/driver chip, such as, for example, that manufactured by National Semiconductor Corp. of Santa Clara, Calif. under the designation 74C48, may be used for decoder/display driver 20 to drive the digital display 22.

FIG. 2 depicts a typical shock pulse history or club head deceleration curve as a function of time. The total time duration of the pulse shown in FIG. 2 is in the range of one millisecond. Point A represents initial impact of the club head with the ball where club head velocity is approximately constant and acceleration is, therefore, essentially zero. Upon impact, the club head rapidly decelerates to a peak deceleration at point B. Thereafter, deceleration decreases rapidly to point C. Essentially, the system of the present invention senses the total energy of the deceleration shock pulse and converts this value to an equivalent analog DC voltage which is thereafter converted to digital signals and displayed to the user.

FIG. 3 depicts typical accuracy of the system of the present invention during actual testing with the system installed in a golf club. Line D represents no range error or 100% accuracy. From FIG. 3 it will be seen that the range measured by the system, i.e., predicted range, for generally straight shots closely correlates with actual measured range. As would be expected, sliced shots and topped shots fall short of the predicted range, topped shots by an average of about 90 to 100 yards and sliced shots by average of about 40 to 50 yards. It is, of course, possible, in the case of poor shots, for a golfer to correct the distance traveled by deducting a predetermined yardage value from the displayed range to at least provide an approximate range for topped or sliced shots.

In FIG. 4, there is shown a portion of a golf club of the "wood" type comprising a head 30, hosel 32 and shaft 34. Head 30 has an internal cavity 36 arranged along the impact axis X at the center of percussion of the club head. In cavity 36, motion sensor 38, such as a piezoelectric element or the like, is rigidly mounted, for example, by potting in epoxy in a conventional manner. While the invention contemplates that any suitable acceleration sensitive element may be used, the sensor 38 is preferably of very small size and low weight so as to have little or no effect on the basic club head geometry and mass characteristics. Since the peak amplitude of deceleration is quite high, as previously mentioned, and the voltage requirements of the system are relatively low, very small sensors can be readily employed.

A channel 40 communicates with cavity 36 and extends through the head 30 to the hollow center of shaft 34. A pair of electrical conductors 42 are connected to the sensor 38 for supplying the voltage generated thereby to the system circuitry. If desired, channel 40 may also be filled with epoxy at the same time sensor 38 is potted in cavity 36.

Referring now to FIG. 5, the upper portion of shaft 34 is shown extending through a handle portion 44 of the golf club which has a resilient cover 45 therearound. The portion of shaft 34 in handle 44 includes a slightly enlarged, generally cylindrical portion 46 in which there is positioned an electronics housing 48, and an end portion 49 in which display 22 is positioned. Inside housing 48 there is mounted the range measuring and display system circuitry comprising components 12–20 shown in FIG. 1 and a conventional power source, such as miniature power cells of the type used in watches, cameras, and the like. Conductors 42 extend upwardly through the hollow interior of shaft 34, through the bottom of housing 48 and connect with the circuitry therein.

End portion 49 of handle 44 is provided with an integrally threaded recess 50 in which digital display 22 is received. The display 22 is advantageously recessed in handle 44 to afford a degree of shading to thus enhance the visibility of the display in sunlight. An externally threaded transparent window 52 is removably threaded into recess 50 to retain the digital display 22 and housing 48 in their respective positions. Window 42 may also be secured in recess 50 by any other suitable means, such as a retaining ring or the like.

Display "on" switch 26 is imbedded in handle 44, as best seen in FIG. 6, and is actuated by applying manual pressure to the exterior surface of handle 44 adjacent switch 26. Switch 26 includes a pair of normally open electrical contacts 54, 56 connected via conductors 58 to the circuits contained in housing 48. Contacts 54, 56 are resiliently biased into their open position by a flexible insulating material 60 which may comprise a portion of the resilient cover. Application of pressure by manually grasping the covering 45 adjacent the switch and squeezing will urge the contacts 54, 56 into electrical contact. This closing of switch 26 causes discharge of the stored analog voltage signal in circuit 12 to the A/D converter 16 (FIG. 1) and activates the display of range information on digital display 22. If shaft 34 is formed of an electrically conductive material, it may comprise one of the electrical contacts 54, 56 of switch 26.

It will be appreciated by those skilled in the art that additional motion sensors could be mounted in the club head to sense motion in mutually orthogonal directions to the impact axis of the club head. The output of such additional sensors could be advantageously applied to electrical circuits, the outputs of which could be used, for example, to blank the primary range information circuits if an orthogonal motion component of the club head produces a sensor output voltage above a predetermined magnitude. Such predetermined magnitude could indicate, e.g., an improper golf stroke, such as a sliced shot, a topped shot or the like.

A further sophistication of the visual display system of the invention could include the detection and display of directional information, such as "hooking" or "slicing" of the ball. Similarly, impact with the ball at a point other than the center of the club face could also be detected and alphanumeric and/or numeric coded signals digitally displayed to indicate the approximate impact area of the club with the ball, e.g., heel toe, top, bottom. One possibility of detecting offcenter impacts would be to utilize a plurality of motion sensors located in a plane parallel to the club face. For example, the differential output of a sensor located in the toe of the club and another sensor located in the heel of the club could be used to determine whether impact occurred at either the heel or the toe or the center of the club face and by means of simple logic circuitry the proper coded signal could be displayed. A predetermined magnitude of differential output voltage from the heel and toe sensors could disable the display of range and enable the heel or toe display. Discrimination between impacts occurring at the heel or toe could be achieved by logic circuitry which would detect the "sense," i.e., positive or negative, of the differential output voltage and display a code corresponding thereto. Specific alphabetically coded messages could be used to display off-center impact data and, if desired, intermittent display of numeric range and alphabetized directional data could be incorporated.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. An implement for striking and imparting movement to an object along a direction of flight comprising, an athletic implement having a head portion, a handle portion and self-contained means for measuring and displaying the distance traveled by the struck object, said self-contained means including motion sensing means responsive to a component of motion in said direction of flight and mounted in said head portion of the implement for producing an output signal the amplitude of which is proportional to the distance traveled by said struck object along said direction of flight, circuit means mounted in said handle portion of the implement and connected to said motion sensing means for receiving said output signal and for producing digital signals corresponding to the distance traveled by said struck object and digital display means mounted to said handle portion of the implement and connected to said circuit means for receiving said digital signals and for visually displaying an indication of the length of the distance traveled by said struck object in numerical increments of linear measure.

2. The implement of claim 1, wherein said digital display means comprise at least one of a LCD display and a LED display.

3. The implement of claim 1, comprising a golf club including a shaft portion and electrical connection means in said shaft portion for connecting the output of said motion sensing means with said circuit means.

4. The implement of claim 1, including switch means mounted to said handle portion and connected to said circuit means for energizing said digital display means after said object is struck by said implement.

5. The implement of claim 1, wherein said switch means includes pressure actuable electrical contacts resiliently biased in spaced relation to each other.

6. The implement of claim 1, wherein said handle poriton has a free end including a recess for receiving said digital display means therein, said display means being mounted in said recess.

7. The implement of claim 1, wherein said motion sensing means comprises a piezoelectric element responsive to deceleration of said implement upon impact with said object.

8. The implement of claim 1, wherein the output signal of said sensing means comprise analog electrical output signals and said circuit means includes means for converting said analog signals to said digital signals.

9. An implement for impacting and imparting movement to an object along a direction of flight comprising an athletic implement including totally self-contained means for sensing a characteristic value of motion resulting from the impact between said implement and object, for converting said sensed value to a digital signal corresponding to the distance traveled by said object along said direction of flight when said object is impacted by said implement and for displaying a visual indication of said traveled distance in numerical increments of linear measure.

* * * * *

UNITED STATES PATENT AND TRADEMARK OFFICE

CERTIFICATE OF CORRECTION

PATENT NO. : 4,088,324

DATED : May 9, 1978

INVENTOR(S) : Everett Walter Farmer

It is certified that error appears in the above-identified patent and that said Letters Patent are hereby corrected as shown below:

Column 4, last line, change "42" to --52--.

Column 6, line 37, change "1" to --4--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*